US006998023B2

(12) United States Patent
Crook

(10) Patent No.: US 6,998,023 B2
(45) Date of Patent: Feb. 14, 2006

(54) PAPERMACHINE CLOTHING

(75) Inventor: Robert L. Crook, Wilson, NC (US)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 10/399,544

(22) PCT Filed: Oct. 18, 2001

(86) PCT No.: PCT/IB01/02730

§ 371 (c)(1),
(2), (4) Date: Jul. 14, 2003

(87) PCT Pub. No.: WO02/33170

PCT Pub. Date: Apr. 25, 2002

(65) Prior Publication Data

US 2004/0033748 A1 Feb. 19, 2004

(51) Int. Cl.
*D21F 7/08* (2006.01)

(52) U.S. Cl. ..... 162/358.2; 162/900; 442/270; 442/271; 428/112; 428/113; 428/114; 428/401

(58) Field of Classification Search ..... 162/204–207, 162/306, 348, 358.2, 358.4, 900–904, 116, 162/117; 34/114–123; 139/383 A, 425 A; 442/268–271, 359, 360, 402; 428/112–114, 428/105, 212, 332, 401
See application file for complete search history.

(56) References Cited

U.S. PATENT DOCUMENTS

| | | | | |
|---|---|---|---|---|
| 3,392,079 A | * | 7/1968 | Fekete | 428/113 |
| 3,928,699 A | * | 12/1975 | Fekete | 428/212 |
| 4,162,190 A | * | 7/1979 | Ashworth | 162/358.2 |
| 4,199,401 A | * | 4/1980 | Liu et al. | 162/358.2 |
| 4,743,482 A | | 5/1988 | Johansson et al. | |
| 4,781,967 A | | 11/1988 | Legge et al. | |
| 4,830,915 A | * | 5/1989 | Diaz-Kotti | 428/110 |
| 4,878,278 A | | 11/1989 | Hsu et al. | |
| 5,137,601 A | * | 8/1992 | Hsu | 162/358.2 |
| 5,202,170 A | * | 4/1993 | Hsu et al. | 428/48 |
| 5,372,876 A | | 12/1994 | Johnson et al. | |
| 5,549,967 A | | 8/1996 | Gstrein | |

FOREIGN PATENT DOCUMENTS

| | | |
|---|---|---|
| DE | 40 40 861 A1 | 7/1992 |
| EP | 0 211 471 A1 | 2/1987 |
| EP | 0 464 258 A1 | 1/1992 |
| EP | 0 665 329 A1 | 8/1995 |
| EP | 1 067 238 A2 | 1/2001 |

* cited by examiner

*Primary Examiner*—Eric Hug
(74) *Attorney, Agent, or Firm*—Caesar, Rivise, Bernstein, Cohen & Pokotilow, Ltd.

(57) ABSTRACT

Papermachine clothing comprising a woven or non-woven support layer, a non-woven layer comprising ultra-coarse non-continuous fibers orientated close to the intended running directions of the clothing and two further layers of batt each comprising conventional somewhat finer staple fibers predominantly aligned close to the cross-machine direction. The ultra-coarse non-continuous fiber layer may comprise two such layers, one of which is biassed at an angle A to the running direction X of the clothing, the other of which is biased at an opposite angle B to the running direction X to provide a layer whose fibers while being substantially orientated in the machine direction also have a bi-axial construction with a cross-orientation.

39 Claims, 3 Drawing Sheets

PAPERMACHINE CLOTHING

The present invention relates to papermachine clothing and particularly, but not exclusively, to a fabric for use in the pressing section of a papermaking machine.

U.S. Pat. No. 4,743,482 discloses the use of a protective flap over the seam area on a papermakers belt, the protective flap comprising a layer of longitudinal fibres which extend in the direction of movement of the belt. The seam is usually the most vulnerable area of the belt and the fibres are intended to reduce the wear of the belt in this region and thereby increase the life of the belt. The fibres are only provided in the seam region and do not extend over the length of the woven layer to provide a shield to prevent marking of the transported paper sheet.

U.S. Pat. No. 5,372,876 describes a press felt with an added flow control layer comprising spun bonded filamentary nylon material treated with hydrophobic chemical composition. The layer is needled onto a base fabric with a batt layer needled on top. The purpose of this invention is solely to prevent rewet taking place on the felts exit from the nip.

EP 1,067,238 describes a press fabric comprising a base fabric and several layers of staple fibre material attached to the base fabric by needling. The base fabric has at least one layer assembled by spirally winding a woven fabric strip. The base fabric is endless and the yarns of the woven fabric strip accordingly lie in directions different from the machine and cross-machine directions of the base fabric giving the base fabric multi-axial characteristics, that is the individual woven strips in the several layers are predominately orientated at oblique angles relative to the machine direction of the press fabric. More specifically, they form a criss-crossed angular web. However, because the fabric which is spiralled is composed of yarn, a special seal or 'selvage' is required in order to prevent the yarns from unravelling and 'stringing' out of the structure. This can be expensive and time consuming to apply and can lead to mass, caliper or water flow non-uniformity in a localised area. The edges of the woven strips are furthermore particularly sensitive to how they are butted together, in that gaps or overlaps may lead to significant pressure variation and consequential marking of a paper sheet in use. In order to alleviate this latter drawback, the edges are generally stitched together by a special sewing operation, further adding to the costs.

U.S. Pat. No. 3,928,699 describes papermachine clothing which has a batt layer of relatively coarse, rigid, randomly arrayed non-deformable fibres provided on a base fabric and covered by a batt surface layer comprising finer fibres. Although the fibres have been described as coarse, these fibres only have a dtex of 17 (44 microns). This 'coarse' is provided purely to increase the void volume for the reception and carrying of water through the press-nip.

Generally speaking papermaking machines are made up of three sections, namely the forming, pressing and drying sections. In each section an endless engineered fabric is used to transport a continuous paper sheet through the papermachine. The structure of the fabrics for each section differs, as the functions of each section of the papermachine are different. A press fabric for the pressing section must be capable of rapidly absorbing and expelling water while supporting the newly formed paper sheet and for this purpose a typical press fabric, as best illustrated in FIG. 6, is formed from a woven carrier weave 4 below which is a batt layer 10, and on top is a fine woven top cloth 12, which is covered by a further batt layer (top layer) 8. The layer 10 is either additional batt or batt needled through from the top layer 8. The batts 8, 10 used at present consist of fibre orientated mainly in the cross-machine direction, that is lateral to the running direction of the press fabric. The fine top cloth 12 is provided to reduce possible marking of the transported paper by the woven carrier weave 4 and thereby improve paper smoothness. The fine top cloth 12 typically has 25 machine direction yarns per cm (60 machine direction yarns per inch) and 12.5 cross-machine direction yarns per cm (30 cross-machine direction yarns per inch). The yarn diameter is typically 0.2 mm (0.008 inches). However even with such a fine structure for the top cloth 12, this cloth still has knuckles and empty space and this can result in a non-uniform pressing of the paper by the fine top cloth with possible marking of the paper.

It is an object of the present invention to provide a papermakers fabric that gives improved uniformity of upthrust in the press nip, leading to enhanced web dewatering and improved sheet smoothness, whilst still maintaining long term openness and void volume necessary for sheet dewatering and superior mechanical seam flap integrity.

In accordance with a first aspect of the present invention there is provided papermachine clothing comprising a carrier layer and a needle punched non-woven layer composed of ultra coarse non-continuous fibres on the sheet side of said carrier layer, the fibres of said non-woven layer are orientated substantially in the intended machine direction of the papermachine clothing. The non-woven layer replaces the fine top cloth used in the known papermachine clothing and has the advantage of providing improved reduction in the possible marking by the carrier layer of the transported paper.

An advantage of machine-direction orientated fibre as opposed to cross-machine direction orientated or randomly orientated fibre, is that it allows for enhanced water handling in that it provides less resistance to water flow in the press nip. The fibres orientated in machine-direction act as channels to conduct the water away as opposed to the fibres when orientated in the cross-machine direction which can effectively act like dams and thereby block the path of water therethrough.

Preferably, there are at least two of said ultra coarse non-woven layers, the fibres of each layer being orientated at a slight angle to the intended machine direction of the clothing and with at least a biaxial lay. This at least biaxial construction allows the ultra coarse layers to provide equivalent caliper and compaction resistance to that of a woven top cloth or other yarn, but with superior pressure uniformity and with less water flow resistance. This gives the net result of greater sheet quality through the life of the papermachine clothing.

The non-woven layer(s) comprise ultra-coarse fibres having a fibre count in the range of 75 to 150 dtex and more preferably 100 dtex. They may be approximately 75 mm in length. This ultra-coarse diameter of the non-continuous fibres helps to maintain the caliper under load and long term compaction resistance.

In a preferred embodiment the fibres of the web are bonded by an adhesive means. Preferably, the adhesive means is a low melt copolymer fibre. More preferably the adhesive means is a bi-component fibre having a low-melt sheath. The fibre count of the bi-component fibres may be between 17 and 67 dtex. The adhesive means may form between 5 to 40% of the coarse non-woven layer. More preferably the percentage component by weight of said adhesive means is 10%. The fibres of the adhesive means may be crimped.

Alternatively, the ultra coarse non-continuous fibres may comprise low melt sheaths, so removing the need for additional fibrous material. On the other hand, the bonding means may be in the form of a non-fibrous adhesive, which for example may be sprayed on to the ultra-coarse non-continuous fibrous layer.

The copolymer may be a crimped fibre such as K140 supplied by EMS Grilon having a dtex of 11. It could be thermally fused before or after layering onto the papermachine clothing. Other fibres could be blended therein to reduce permeability, etc for certain applications.

The provision of a low melt material not only bonds fibres to fibres, but it also improves structural compaction resistance and resiliency.

The ultra-coarse non-woven layer may be affixed to the sheet side of the carrier via the interposition of a layer of batt material, the fibres of the interposed batt material being less coarse than that of the ultra-coarse non-woven layer.

In a preferred embodiment a batt layer is provided on the paper supporting side of said clothing, said layer forming a top batt layer. The top batt layer improves sheet support and the mechanical locking of the carrier layer to the ultra coarse non-woven layer. Preferably the fibres of the layer are less coarse than those of the ultra-coarse layer, the fibres of the top batt may have a fibre count in the range of 3.3 to 22 dtex, and more preferably 3.3. The top batt layer may comprise at least two layers, preferably the fibres of at least one of these layers is less coarse than the fibres of the other layers, one of these layers may have a fibre count in the range of 17 to 44 dtex. At least one layer of the top batt may be orientated in the cross-machine direction.

A further batt layer or bottom batt layer may be provided on the opposite side of the carrier layer on the machine facing side thereof, the fibres of the bottom layer being orientated in substantially the machine or the cross-machine direction. The bottom batt layer may simply be created from the top batt layer which is pushed down through the carrier layer to the underside thereof by the process of needling.

In accordance with a second aspect of the present invention there is provided paper machine clothing comprising a carrier layer and at least two needle punched non-woven layers composed of ultra-coarse non-continuous fibres provided on the sheet side of said carrier layer, the fibres of one of said layers being orientated in substantially at least a first direction and the fibres of the other of said layers being orientated substantially in at least a second direction.

In accordance with a third aspect of the present invention there is provided a method of making papermachine clothing comprising the steps of:

providing a carrier layer;

providing a first non-woven layer composed of ultra-coarse non-continuous fibres whose fibres are orientated substantially in a first direction;

providing a second non-woven layer composed of ultra-coarse non-continuous fibres whose fibres are orientated substantially in a second direction, and mechanically attaching said first and second non-woven layers to the carrier layer.

In a preferred embodiment said first direction is a first slight angle to the intended machine direction of the clothing, and said second direction is a second slight angle to the intended machine direction of said clothing to provide a non-woven layer whose fibres have a bi-axial construction with respect to the running direction.

Preferably the two said slight angles are between 5° and 30°, more preferably 10° to 15°.

More preferably said step of mechanically attaching is by spirally winding said first non-woven layer on the said carrier layer, spirally winding said second non-woven layer on said first non-woven layer, and then needling said first and second non-woven layers to said carrier layer.

Unlike the spiralling process described in EP 1,067,238, the needle-punched spirally wound ultra-coarse layer lends itself to edges just being butted together or slightly 'feathered' and overlapped when spiralled. The subsequent needling entangles the coarse staple fibres together in a homogenous manner without gaps or ridges so leading to pressure uniformity.

In order to aid carding of the ultra-coarse non-continuous fibre, it has been found that the addition of fine fibrous material acts as a vehicle to carry the coarse fibres through the carding engine.

During manufacture the predominately coarse fibre web does not proceed past the carding engine to the conventional cross layer system. Instead it is wound up directly after a light needling, such that when it is unwound on the carrier layer the fibre orientation lies predominantly in the machine direction. Use of the conventional cross laying system with coarse fibres is impossible because of the unavoidable drafting phenomenon, which occurs prior to entry into the pre-tacking needling machine. Such drafting tears the weak web apart or at best it creates an unacceptable lack of uniformity.

Preferably the two biaxial-orientated layers are bonded by the additional step of providing a low-melt adhesive within the coarse layer. The subsequent heat-setting process helps to bond the coarse fibres into a 3D matrix layer, improving the maintenance of void volume with consequential greater dewatering capabilities and enhanced inter-layer bonding with reduction in possible delamination. The additional fibres may advantageously comprise said low-melt adhesive.

Preferably at least one batt layer is mechanically attached to the clothing.

This further batt layer may comprise two layers, the fibres of a first layer being adjacent to the said web of coarse staple fibres, and are less coarse than the fibres of said non-woven layer, but coarser than the fibres of the second layer of batt. In a preferred embodiment the fibres of the first layer has a dtex of 17 and the fibres of the second layer has a dtex of 3.3. In a further preferred embodiment the fibres of the said first layer has a dtex of 44 and the fibres of the said second layer has a dtex of 17.

At least one layer of batt may also be provided between the web of coarse fibres and the support layer. Preferably the fibres of this at least one layer of batt is less coarse than the fibres of the web of coarse staple fibres. When more than one layer of such batt is provided, the layers may have varying dtexes. The dtex of the at least one layer of batt may be in the order of 44.

Preferably the fibres in at least one of the further batt layers are orientated in substantially the cross-machine direction of the clothing.

By providing a layer of ultra-coarse non-continuous fibres which extend substantially in the running (machine) direction of the clothing there are no weave knuckles when compared to the fine cloth 12 of the prior art construction or empty space and therefore a reduction in strike through of the knuckles to the sheet. Also the non-woven layer is cheaper and quicker to produce than a woven fabric. It has been found to give a fast start-up time on the papermachine with a greater retention of felt properties in comparison to conventional woven structures.

The biaxial laying of the fibres in the ultra coarse staple web has particularly been found to provide an outstanding long term compaction resistance because the fibres are self-supporting under compression, resulting in superior ability to maintain caliper, ease of cleaning and openness over life.

Water flow is evenly distributed through the clothing because there are no hard dense yarns that can restrict and channel flow, and so hydraulic resistance is minimised. This gives excellent sheet moisture profiles and long term dewatering and cleaning efficiency.

With conventional laminates, comprising a fine top cloth and a top layer 8 of conventional batt having been needled to the substrate, it is often found that during the course of a seamed felt fabric's life that delamination occurs particularly at the seam. This causes the batt to peel away from the substrate. In the present invention, ultra-coarse, non-continuous fibres which replace the top cloth, are entrapped between the conventional batt and base giving excellent fibre anchoring. Due to the increased cross-over points gained by having fibres, the needling is much more effective than when needling a woven cloth. Also, further added adhesion may be gained from the use of low-melt or bi-component fibres dispersed within the ultra-coarse fibres, which are melted either during an initial pre-heating step, if oen is included, or during the final fabric heat setting stage.

Alternatively, a stiffening agent can be applied to the ultra-coarse fibrous web in order to enable it to be unwound in spiral fashion on to the carrier layer, without the creation of creases or mis-register. The stiffening agent may be a spray on chemical such as starch.

By way of example only specific embodiments of the present invention will now be described with reference to the accompanying drawings, in which.

Figure 1:
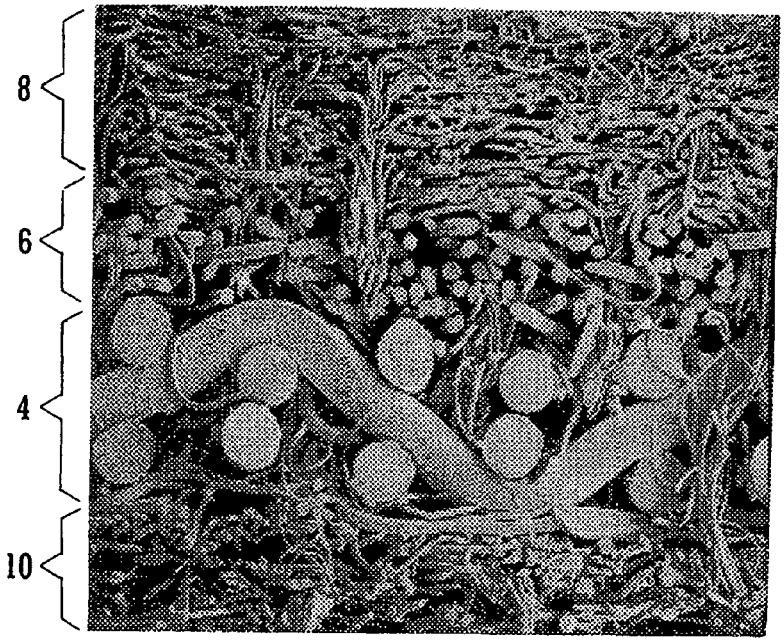
FIG. 1 is a sectional view taken in the cross-machine direction of papermachine clothing constructed in accordance with one embodiment of the present invention.

Referring to FIG. 1 a first embodiment of papermachine clothing comprises a woven base layer 4, a non-woven layer 6 comprising coarse fibres orientated in the intended running direction of the clothing and two further layers of conventional batt 8, 10 each comprising conventional staple fibres predominantly aligned close to the cross-machine direction.

Figure 2:
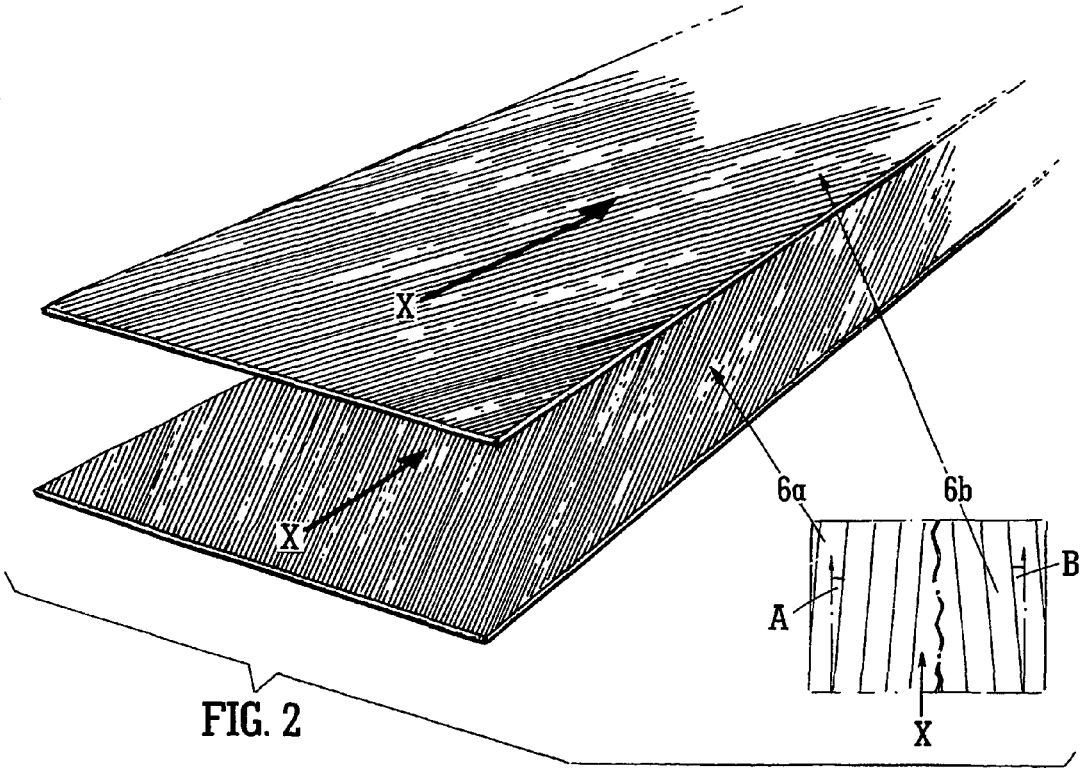
FIG. 2 is an exploded schematic of the length orientated ultra coarse non-continuous fibres in the non-woven layer of FIG. 1.

As best illustrated in FIG. 2 the machine direction orientated non-woven layer 6 comprises a layer of coarse fibres 6*a* biased at an angle A to the running direction X of the clothing and mechanically bonded to the base layer 4. The coarse fibres 6*a* are laid on to the base layer 4 by winding on the needling machine in a spiral fashion. The process is then reversed to place a second layer of coarse fibres 6*b* on top of the first layer 6*a*, the second layer 6*b* being biased at an opposite angle B to the running direction X. This results in a non-woven layer 6, the fibres of which are substantially orientated in the machine direction also have a bi-axial construction with a cross-orientation.

The angle to the running direction at which the respective coarse fibres 6*a*, 6*b* are laid depends on the length of the clothing, but for a 20 metre fabric, the approximate angle A and B depending on the width of the non-woven layer, ranges from 5° to 10°.

The two layers of non-woven web 6*a*, 6*b* comprise individual crimped fibre having a dtex of 100. The layers 6*a* and 6*b* of the non-woven layer 6 are mechanically interlocked by a needle punching process and preferably bonded using a low melt nylon copolymer crimped staple fibre having a dtex of 11, supplied by EMS Grilon under the trade name of K140 which under the influence of the heat setting process fuses the fibres together. The staple fibre forms 10% of the layer 6. The batt layers 8, 10 are then needled to the resultant base layer 4 and layer 6 combination in the usual fashion to complete the clothing.

Figure 3:
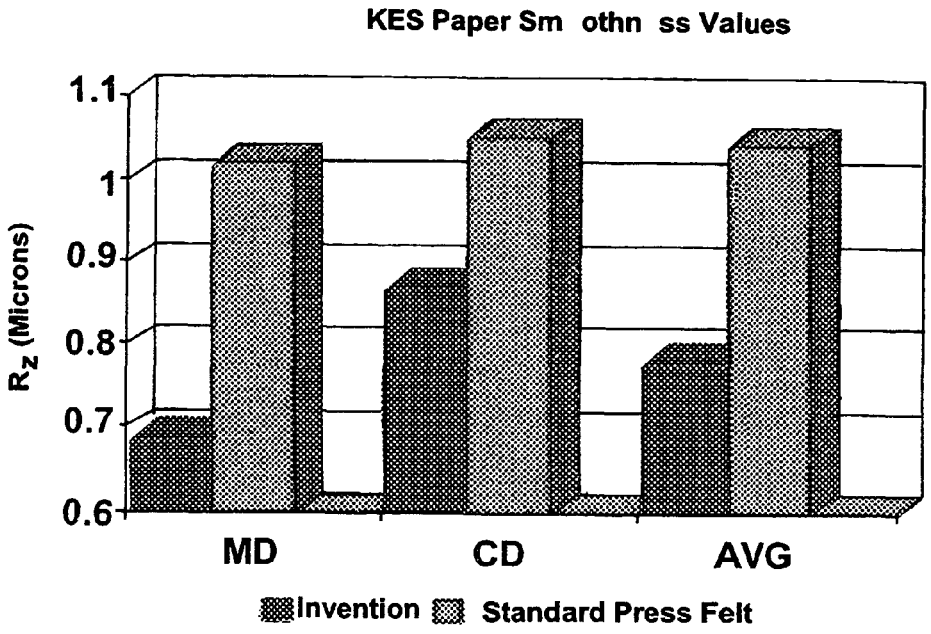
FIG. 3 is a graph showing KES paper smoothness values for paper manufactured using clothing constructed in accordance with the invention compared with that manufactured using a conventional press fabric.

In FIG. 3 the smoothness of the paper manufactured using the clothing constructed in accordance with the invention, is compared against that manufactured using standard papermachine clothing in which a fine woven cloth layer is provided over the woven base layer which is covered with conventional cross-machine direction batt. The data shown was measured following trials comparing the smoothness of paper produced in a single felted nip press, the measurements showing the smoothness values for the side of the paper sheet in contact with the felt in question. The chart illustrates KES smoothness in which the lower the number, the smoother the surface. The KES smoothness is measured by an instrument manufactured by Kato Tech Company of Kyoto, Japan. This instrument uses a stylus to trace the surface of a sample approximately 8×5 cm (3"×2") at a constant speed of 1 mm/second with a constant downward pressure of 20 g over a distance of 25 mm. The smoothness value $R_Z$ is calculated from the average of the five highest and lowest peak to peak values and is measured in microns. An X-Y recorder aids in the graphing of these numerical results.

FIG. 3 compares the machine direction, cross machine direction and average smoothness values for paper produced in a single felted nip press using a) the present invention and b) a standard press felt. The smoothness values $R_Z$ are for the paper surface in contact with the felt in question. The results demonstrate that the present invention produces paper with a superior smoothness.

Figure 4:
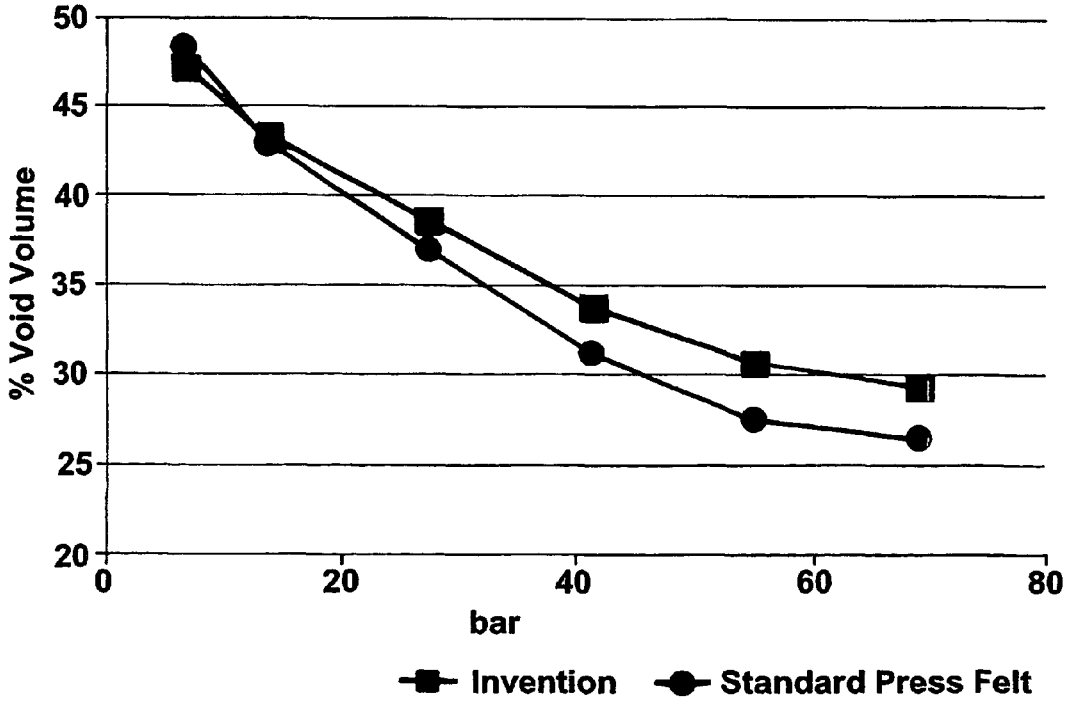
FIG. 4 is a graph comparing percentage void volume of the clothing of FIG. 1 with that of the prior art clothing of FIG. 6.

FIG. 4 illustrates a further comparison of the present clothing to the said standard press felt in which the percentage void volume is compared over increasing pressures. The present clothing demonstrates consistently higher values of void volume. This is attributable to the biaxial-orientation of the coarse fibres of layer 6 which are self-supporting under compression, resulting in a superior ability to maintain caliper, ease of cleaning and openness over the course of its life.

Figure 5:
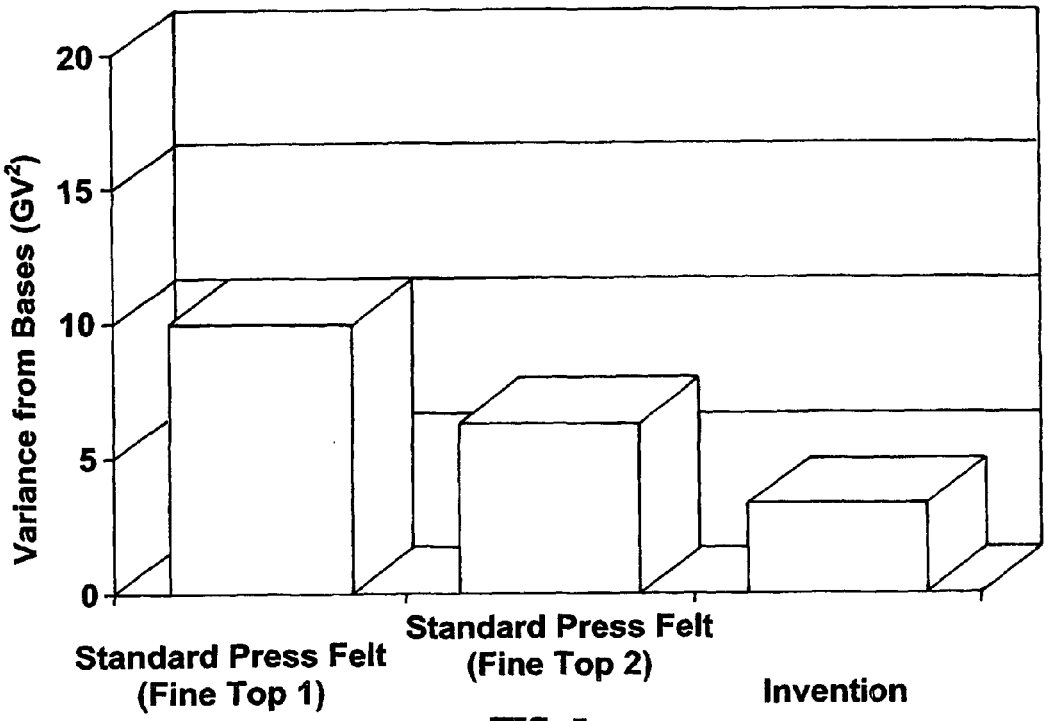
FIG. 5 is a graph similar to FIG. 4 showing a comparison of marking propensity of the Woven carrier base of the clothing of the invention with two examples of prior art clothing of FIG. 6.
Figure 6:
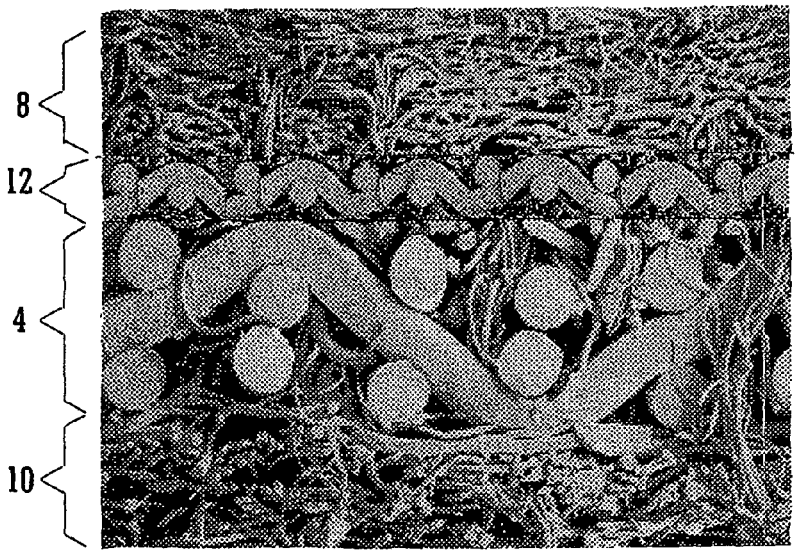
FIG. 6 is a view similar to that of FIG. 1 but illustrating the construction of a prior papermachine clothing.

FIG. 5 illustrates a comparison of the marking propensity of the woven carrier base of the present clothing with that of two standard press felts in which a fine top cloth is used to reduce strike through from the woven base fabric to the paper web. The three fabrics are all comparable, with the exception being that the present clothing utilises an ultra-coarse non-continuous fibrous layer instead of the fine top cloth. Both of the fine top cloths are woven, with fine top 1 comprising slightly coarser yarns than fine top 2. The variance shown using (Eureka analysis) on the chart is the mark strength measured in Grey Value squared ($GV^2$), which gives an indication of the marking propensity of the woven base fabric. The test is conducted by making a carbon impression in the nip between the fabric and the roll. The resulting impression is imaged using a desktop scanner. The image is analysed using Fast Fourier Transform (FFT) filtering techniques and any mark from the carrier is detected, isolated and quantified in terms of variance (mean square deviation) in grey values squared (GV2). The greater the variance, the stronger the mark. The chart demonstrates that when the present non-woven layer of ultra coarse non-continuous fibres is used as a replacement for a fine woven top cloth that marking is considerably reduced, even when compared to the finest of such top cloths.

In a further embodiment a conventional batt layer of dtex 44 is initially applied to the base layer 4, before the application of the coarse layers 6*a*, 6*b* of dtex 100 of the batt 6. A further conventional batt layer of dtex 44 is applied on top of the layer 6 and this is capped with a finer conventional batt layer of dtex 17. This type of construction is most suitable for the production of packaging grade, heavy weight paper, because a press-felt suitable for the production of such paper has to have a high void volume and is therefore of a bulkier construction when compared to a clothing suitable for graphic grade paper. The provision of the conventional batt layer of dtex 44 between the layer 6 and the base layer 4 spaces the coarse layers away from the base cloth and thereby pushes the high void volume entity closer to the site of water removal.

Although the top and bottom batts 8, 10 have been described as being orientated substantially in the cross-machine direction, one or each of these layers could also be orientated substantially in the machine direction. Also either or both of the top and bottom batt layers 8, 10 could be omitted, or one of these batt layers could be provided from fibres simply needled through the base layer 4 when the top layer 8 is bound to the clothing.

Although two layers 6*a*, 6*b* have been described for the machine direction orientated ultra coarse fibrous layer 6, this layer could contain just one layer or more than two layers as required for a particular application.

Although the base layer has been described as being a woven layer, it is to be understood that the base layer could be a non-woven layer such as a link fabric, a membrane, a laminate, or an array of machine direction and/or cross-machine directions yarns or a combination thereof. Furthermore, the base layer may be a combination of woven and/or non-woven layers.

Although the ultra-coarse fibres have been illustrated as being substantially circular in cross-section, it is to be understood that-they are not limited to this shape and could be for example of a different shape or flat, or a combination of a variety of such. Furthermore, although the coarse fibres have been described as being crimped, they could have a smooth profile.

Although a low melt nylon co-polymer crimped staple fibre K140 (TM) has been described as being used to bond the layers of the ultra-coarse non-continuous fibres, other adhesives in fibrous form could be used, such as thermoplastic meltable fibres such as polypropylene, or for example these fibres may also be in the form of core/sheath bi-component fibres with a low melt sheath component. The fibres are furthermore not necessarily crimped. The fibres may also simply be finer and non-meltable, Also, the fibres could be replaced by a bonding agent, such as an adhesive for example polyurethane. Furthermore, the ultra coarse non-continuous fibres could be bi-component comprising a low-melt sheath. It is to be understood that any meltable components may be melted before or after the initial needling of the web, or during the final fabric heat-setting stage. A chemical stiffening agent such as starch could be sprayed onto the ultra-coarse non-continuous fibrous layer. The stiffening of the ultra-coarse non-continuous fibrous layer aids the spiral winding of that layer onto said carrier layer(s).

Continuous machine direction yarns could be incorporated within the layer of coarse fibres, or within one of the other layers of the papermachine clothing, in order to provide resistance to stretch on the papermachine. A particular suitable yarn would have a diameter of 0.2 mm and be twisted in a 2 ply 2 cable form at 11 ends per cm (28 ends per inch).

In a further embodiment (not illustrated) the layer of ultra-coarse non-continuous fibre is needled onto a substrate of spun bond fabric. The substrate is not endless and the coarse fibres are not spirally wound but are instead aligned substantially in the machine direction. This structure is then turned through 90° and is then laminated onto another substrate of spunbond fabric. This structure provides better sheet support for some paper grades because of the cross-machine, rather than machine direction orientation of the coarse fibres. The laminate structure may comprise several such layers of coarse non-woven fibres and such may have a machine direction layer(s) alternated with cross-machine directed layer(s), this structure provides an improved structural compaction resistance. Although the substrate has been described as spun bonded, it may be a woven and or other non-woven substrate or a combination of such. Furthermore, reinforcing yarns may be included as described above, as can various batt layers Adhesives such as bi-component fibres or bi-axial fibres or additional finer fibres as described above may be included within the non-woven layers to enhance bonding as described above. The completed structure could be end-butted to form an endless structure.

While the invention has been disclosed herein in connection with certain embodiments and certain structural details, it is clear that further changes, modifications or equivalents can be used by those skilled in the art; accordingly, such changes within the principles of the invention are intended to be included within the scope of the claims.

The invention claimed is:

1. Papermachine clothing comprising a carrier layer and a needle punched non-woven layer composed of ultra coarse non-continuous fibres on the sheet side of said carrier layer, said non-woven layer including at least two non-woven angled layers, the ultra coarse non-continuous fibres of each non-woven angled layer being oriented substantially at a slight angle in the range of about 5° to about 30° to the intended machine direction of the papermachine clothing, and with at least a biaxial lay.

2. The papermachine clothing of claim 1, wherein the non-woven layer has a dtex of 100.

3. The papermachine clothing of claim 1, wherein the non-woven layer is composed of individual, chopped filaments having a length of approximately 75 mm.

4. The papermachine clothing of claim 1, wherein the fibres of the non-woven layer are bonded together by adhesive means.

5. The papermachine clothing of claim 4, wherein the percentage component by weight of the non-woven layer of the adhesive means is between 5 to 40% of the said non-woven layer.

6. The papermachine clothing of claim 4, wherein the percentage component by weight of the adhesive means is 10% of said non-woven layer.

7. The papermachine clothing of claim 4, wherein the adhesive means comprises low-melt co-polymer fibres.

8. The papermachine clothing of claim 7, wherein the copolymer fibre is K140 supplied by EMS Grilon typically having a dtex of 11.

9. The papermachine clothing of claim 4, wherein the adhesive means comprises bi-component fibres which have a low-melt sheath.

10. The papermachine clothing of claim 9, wherein the bi-component and/or co-polymer fibres are crimped.

11. The papermachine clothing of claim 4, wherein the adhesive means comprises fibres having a dtex between 17 and 67, and more preferably 30.

12. The papermachine clothing of claim 11, wherein the fibres are thermoplastic.

13. The papermachine clothing of claim 4, wherein the adhesive means comprises a low-melt sheath around said ultra coarse non-continuous fibres.

14. The papermachine clothing of claim 1, further comprising additional fibres mixed in said ultra-coarse layer, said additional fibres being less coarse than said ultra-coarse fibres.

15. The papermachine clothing of claim 1, further comprising a batt layer located between the carrier layer and said ultra-coarse non-woven layer, the fibres of said batt being less coarse than those of said ultra-coarse non-woven layers.

16. The papermachine clothing of claim 1, further comprising a top batt layer located on the sheet side of said clothing.

17. The papermachine clothing of claim 16, wherein the fibres of said top batt layer are less coarse than those of said ultra-coarse layer.

18. The papermachine clothing of claim 16, wherein said top batt comprises at least two layers, the fibres of at least one of these layers being less coarse than the fibres of the other layers of said top batt.

19. The papermachine clothing of claim 18, wherein the fibres of the top-most batt layer have a dtex in the range 3.3 to 22.

20. The papermachine clothing of claim 18, wherein the fibres of the lower-most top batt layer have a dtex of 17 to 44.

21. The papermachine clothing of claim 1, further comprising a bottom batt layer provided on the machine side of said clothing, the fibres of the bottom batt layer being orientated in substantially the cross-machine direction.

22. The papermachine clothing of claim 1, further comprising reinforcing yarns which lie substantially in the intended machine-direction of said clothing.

23. Papermachine clothing comprising a carrier layer and a needle punched non-woven layer composed of ultra coarse non-continuous fibres on the sheet side of said carrier layer, the fibres of said layer being oriented in substantially the intended machine direction of the papermachine clothing, wherein the non-woven layer has a fibre count in the range of 75 to 150 dtex, and the fibres of the non-woven layer are bonded together by adhesive means.

24. A method of making papermachine clothing comprising the steps of:

providing a carrier layer;

providing a first non-woven layer composed of ultra-coarse non-continuous fibres whose fibres are orientated substantially in a first direction;

providing a second non-woven layer composed of ultra-coarse non-continuous fibres whose fibres are orientated substantially in a second direction, and mechanically attaching said first and second non-woven layers to the carrier layer, wherein said first direction is a first slight angle to the intended machine direction of the clothing, and said second direction is a second slight angle to the intended machine direction of said clothing to provide a non-woven layer whose fibres have a bi-axial construction with respect to the running direction.

25. The method of claim 24, wherein said step of mechanically attaching is by spirally winding said first non-woven layer on the said carrier layer, spirally winding said second non-woven layer on said first non-woven layer, and then needling said first and second non-woven layers to said carrier layer.

26. The method of claim 24, characterised by the two said slight angles being in the range 5° to 30°.

27. The method of claim 24, characterised by the two said slight angles being in the range 10° to 15°.

28. The method of claim 24, further comprising the additional step of mechanically attaching at least one batt layer.

29. The method of claim 28, wherein the additional step of mechanically attaching comprises mechanically attaching two such batt layers, the fibres of a first of said batt layers being adjacent to one of said non-woven layers of coarse fibres and being less coarse than the fibres of said coarse non-woven layer but coarser than the fibres of the second layer of said batt.

30. The method of claim 29, characterised by the fibres of the first layer of said batt has a dtex of 17 and the fibres of the second batt layer has a dtex selected from the group comprising 11 and 3.3.

31. The method of claim 29, characterised by the fibres of the first layer of said batt having a dtex of 44 and the fibres of the said second batt layer having a dtex of 17.

32. The method of claim 24, further comprising the step of providing an additional batt layer between the non-woven layers and the support layer.

33. The method of claim 32, characterised by the fibres of the additional batt layer being less coarse than the fibres of the non-woven layers.

34. The method of claim 33, wherein the step of providing said additional batt layer comprises providing at least two of such batt layers, the layers having differing dtexes.

35. The method of claim 24, comprising the additional step of stiffening the non-woven layers.

36. The method of claim 35, wherein the step of stiffening comprises spraying a chemical stiffening agent on said coarse fibres of said non-woven layer.

37. The method of claim 35, wherein to aid carding additional fibres in said non-woven layers, said additional fibres being less coarse than said ultra-coarse fibres.

38. The method of claim 35, wherein the step of stiffening comprises bonding the two non-woven layers is effected by providing adhesive means within the coarse non-woven layers and then heat-setting.

39. Papermachine clothing, comprising:

a carrier layer;

a first non-woven layer attached to said carrier layer, said first non-woven layer composed of ultra-coarse non-continuous fibres oriented substantially in a first direction at a first slight angle to the intended machine direction of the papermachine clothing; and a second non-woven layer attached to said carrier layer, said second non-woven layer composed of ultra-coarse non-continuous fibres oriented substantially in a second direction at a second slight angle to the intended machine direction, said first and second non-woven layers forming a combined non-woven layer with fibres having a biaxial construction with respect to a running direction.

* * * * *